US008950891B2

(12) United States Patent
Egger et al.

(10) Patent No.: US 8,950,891 B2
(45) Date of Patent: Feb. 10, 2015

(54) LAMP HAVING A TUBULAR LAMP BODY, METHOD FOR PRODUCTION OF A LAMP SUCH AS THIS, AND A SPACING ELEMENT

(75) Inventors: Martin Egger, Teisendorf (DE); Christian Senft, Rosenheim (DE)

(73) Assignee: OSRAM AG, Munich (DE)

( * ) Notice: Subject to any disclaimer, the term of this patent is extended or adjusted under 35 U.S.C. 154(b) by 201 days.

(21) Appl. No.: 13/323,846

(22) Filed: Dec. 13, 2011

(65) Prior Publication Data

US 2012/0147596 A1 Jun. 14, 2012

(30) Foreign Application Priority Data

Dec. 14, 2010 (DE) ..... 10 2010 062 998

(51) Int. Cl.

| | |
|---|---|
| ***F21V 21/34*** | (2006.01) |
| ***F21V 23/00*** | (2006.01) |
| ***F21V 17/10*** | (2006.01) |
| ***H01R 43/00*** | (2006.01) |
| ***H01R 9/18*** | (2006.01) |
| ***F21V 25/00*** | (2006.01) |
| ***F21V 17/16*** | (2006.01) |

(52) U.S. Cl.

CPC ..... *F21V 25/00* (2013.01); *F21V 17/164* (2013.01); *F21V 23/002* (2013.01)

USPC ..... 362/217.17; 362/217.14; 362/221; 29/749; 445/33

(58) Field of Classification Search

USPC ..... 362/217.1–217.17, 219, 221, 222, 391; 29/749, 428; 445/29, 33, 46, 49

See application file for complete search history.

(56) References Cited

U.S. PATENT DOCUMENTS

| | | | | |
|---|---|---|---|---|
| 2,935,782 | A * | 5/1960 | Rangabe | 445/33 |
| 5,204,583 | A * | 4/1993 | Jeong | 313/496 |
| 5,753,996 | A * | 5/1998 | Csoknyai | 313/318.05 |
| 6,932,495 | B2 * | 8/2005 | Sloan et al. | 362/294 |
| 7,012,361 | B2 * | 3/2006 | Kanesaka | 313/493 |
| 7,165,863 | B1 * | 1/2007 | Thomas et al. | 362/219 |
| 7,241,031 | B2 * | 7/2007 | Sloan et al. | 362/373 |

FOREIGN PATENT DOCUMENTS

| | | | |
|---|---|---|---|
| CA | 946139 | A1 | 4/1974 |
| DE | 1916903 | U | 6/1965 |
| DE | 1916903 | A1 | 3/1971 |
| DE | 9300896 | U1 | 4/1994 |
| DE | 202005019282 | U1 | 5/2007 |

* cited by examiner

*Primary Examiner* — Alan Cariaso

(57) ABSTRACT

The various embodiments relate to a lamp having a tubular lamp body, wherein at least one first line harness and one second line harness, or at least one first line and one second line, are arranged in the tubular lamp body, wherein the lamp furthermore has at least one spacing apparatus, which is arranged in the lamp and is designed to fix at least the first line harness and the second line harness or the first line and the second line at a predeterminable distance (D) from one another, at least in places. The various embodiments further relate to a method for production of a lamp such as this, and to a spacing element.

15 Claims, 4 Drawing Sheets

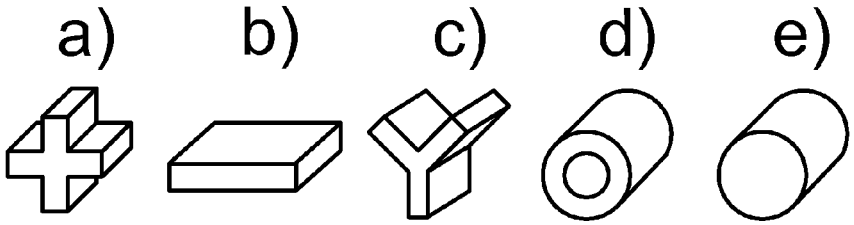
Fig.5
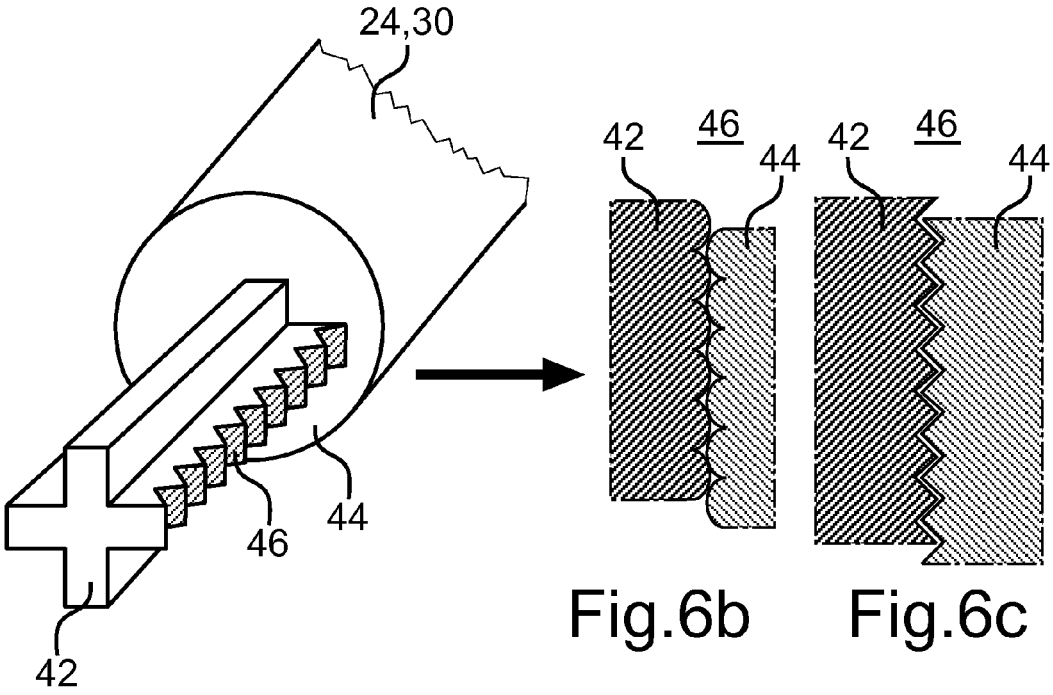
Fig.6b Fig.6c
Fig.6a

LAMP HAVING A TUBULAR LAMP BODY, METHOD FOR PRODUCTION OF A LAMP SUCH AS THIS, AND A SPACING ELEMENT

RELATED APPLICATION

The present application claims priority from German application No. 10 2010 062 998.7 filed on Dec. 14, 2010.

TECHNICAL FIELD

Various embodiments relate to a lamp having a tubular lamp body, wherein at least one first line harness and one second line harness, or at least one first line and one second line, are arranged in the tubular lamp body. The various embodiments further relate to a method for production of a lamp such as this, and to a spacing element.

BACKGROUND

It is a known problem that electromagnetic interference can occur in lamps between so-called lamp lines on the one hand and mains and control lines on the other hand. In this case, lamp lines provide the electrical connection between an electronic ballast and at least one lighting means. The power for operation of the lighting means is transmitted on this connection from the electronic ballast to the lighting means. A signal at a high alternating or constant frequency is frequently chosen for transmission. In one exemplary embodiment, this is a square-wave signal at a frequency between 10 and 100 kHz.

Mains lines run between a mains connection and the electronic ballast. Control lines transmit control signals for communication with sensors, other lamps or central control units. Depending on the arrangement of the electronic ballast in the lamp, it is also possible for lamp lines on the one hand and mains and control lines on the other hand to run parallel, at least in places. Particularly when wiring is passed to other lamps, the lamp lines and mains and control lines even run predominantly parallel.

The fields around the lamp lines are in this case sufficiently strong to have a negative influence on the EMC behavior of the lamp, because of coupling mechanisms between lamp lines on the one hand and mains and control lines on the other hand. In this case, the lamp line acts as a transmitter, and the mains and control lines act as receivers. In this case, the filter which is normally installed in an electronic ballast can be bridged by this coupling. Electromagnetic interference can be fed in this way into widely distributed mains systems, and can interfere with other equipment.

In order to avoid such electromagnetic interference, lamp lines on the one hand and mains and control lines on the other hand are physically separated as far as possible from one another in the lamp body, in order to keep capacitive and inductive couplings as small as possible. Brackets, curved metal lugs or adhesive points are used for this purpose in the prior art.

SUMMARY

Various embodiments provide measures which make it possible to largely prevent the injection of ENC interference from lamp lines onto mains and control lines, even in the case of lamps having a tubular lamp body.

The various embodiments may be based on the knowledge that the wiring is pushed into the lamp body, in the case of lamps having a tubular lamp body. Since retrospective fixing of the corresponding lines in the lamp body is impossible, a spacing apparatus is provided, by means of which the wiring is prefabricated outside the lamp body. This results in a module which has the lines and the spacing apparatus. This can then be inserted into the lamp body. In this case, the spacing apparatus is designed to fix the first line and the second line, or the first line harness and the second line harness, to one another at a predeterminable distance, at least in places. This makes it possible to ensure that there is a maximum distance between the lamp line on the one hand and the mains and control lines on the other hand over as long a line length as possible. This reduces the injection of electromagnetic interference from the lamp line onto the mains and control lines. The various embodiments are preferably applicable to lamps having a tubular lamp body, but can also be used for other lamp housing shapes.

The spacing apparatus provides robustness in its own right in the lamp, and is preferably manufactured from a material which has no electromagnetic effect.

Instead of a single line, this may also in each case relate to line harnesses, as a result of which these terms can be considered to be synonymous in the following text.

The prefabrication process can be carried out with or without electronic ballast, and with or without any filters.

In one embodiment, the lamp body has a longitudinal axis and a lateral axis, wherein the spacing apparatus likewise has a longitudinal axis and a lateral axis, wherein the longitudinal axis of the spacing apparatus runs parallel to the longitudinal axis of the lamp body when the spacing apparatus is arranged in the lamp body, and wherein the lateral axis of the spacing apparatus runs parallel to the lateral axis of the lamp body when the spacing apparatus is arranged in the lamp body. In this case, the spacing apparatus has at least one spacing element, whose longitudinal axis and lateral axis run parallel to those of the spacing apparatus.

Preferably, in this case, in the lateral direction, the at least one spacing element has a first holding apparatus which is arranged at its first end, for the first line harness or the first line, and has a second holding apparatus, which is arranged at its second end, for the second line harness or the second line. This makes it possible, in principle, to keep the first and the second lines, on the first and the second line harnesses, at a predeterminable distance from one another, by appropriate design of the spacing element.

The at least one spacing element has at least one lateral element which extends in the lateral direction, wherein the at least one lateral element is designed to be stiff, in particular torsionally stiff, and wherein the at least one lateral element is coupled between the first holding apparatus and the second holding apparatus. An embodiment of the spacing element such as this makes it possible to reliably set a predeterminable distance between the first and the second lines, or the first and the second line harnesses.

The first and/or the second holding apparatus is arranged between the at least one lateral element and the lamp body. This means that the holding apparatus or apparatuses rests or rest on the inner face of the lamp body. This makes it possible to exploit the elasticity of the lines and/or of the line harnesses and/or of the holding apparatus or apparatuses, in order on the one hand to allow the module which has been prefabricated in this way to be easily inserted into the lamp body, while nevertheless on the other hand ensuring that the module is held reliably in the lamp body.

Alternatively, the at least one lateral element may be in contact with the lamp body, wherein the first and/or the second holding apparatus or apparatuses are/is arranged at the side on the at least one lateral element. This allows the module to be arranged in a particularly robust manner in the lamp body, guaranteeing reliable positioning within the lamp body, even if the lamp is subject to shaking.

According to one embodiment, the first holding apparatus and/or the second holding apparatus have/has a cable tie for holding the respective line or the respective line harness. This allows the respective line or the respective line harness to be fixed to the spacing element in a particularly simple manner with little weight. The use of a cable tie allows the embodiments to be used universally, independently of the number of lines which are present in a line harness, depending on the lamp. This ensures that the lines or line harnesses do not slide in their holding apparatuses during insertion of the module, that is to say of the prefabricated wiring.

Alternatively, the first holding apparatus and/or the second holding apparatus have/may have a flexible spiral for holding the respective line or the respective line harness. In this case, the respective line or the respective line harness is introduced into the spiral which, because of its flexibility, is particularly suitable for precluding line fractures or damage to the cable insulation. Both when using cable ties and when using flexible spirals, this ensures that the prefabricated wiring slides well and is not tilted during insertion into the lamp body.

According to one embodiment, the at least one lateral element has at least one first coupling apparatus in the longitudinal direction. This allows a plurality of lateral elements to be coupled to one another, thus allowing the various embodiments to be used in an unrestricted manner even in the case of lines or line harnesses which are not manufactured from solid wire but from braids. While, in the case of lines or line harnesses composed of solid wire, the robustness in the longitudinal direction can be ensured by the line or the line harness itself, it is particularly advantageous for lines or line harnesses composed of braid to use spacing elements, which are supported with respect to one another in the longitudinal direction, in order to prevent the prefabricated wiring from being compressed during insertion into the lamp body.

In this context, at least one spacing element furthermore may have at least one intermediate element which has at least one second coupling apparatus, wherein the second coupling apparatus is designed to interact with the first coupling apparatus, in order to couple two lateral elements to one another in the longitudinal direction. The length of the intermediate element therefore makes it possible to take account of the stiffness of the lines or line harnesses. The stiffer the line or the line harness is, the longer the intermediate element can be made, thus making it possible to reduce the number of required spacing elements.

It has been found to be particularly advantageous if the at least one lateral element and/or the at least one intermediate element have/has a telescopic apparatus for variation of their/its length. This allows the various embodiments to be used more uniformly, since prefabricated wiring can be matched to the maximum diameter of the lamp body and to the length of the lamp body, independently of said maximum diameter and length. In particular, this reduces the bearing complexity, since only a small number of different lateral elements and/or intermediate elements need be kept in stock.

In this case, the telescopic apparatus may have at least one first telescopic element, one second telescopic element and an unlocking apparatus, wherein the locking apparatus is designed to fix the first telescopic element, in particular reversibly, at a predeterminable position with respect to the second telescopic element. Accordingly, if it is found after introduction of prefabricated wiring into the lamp body that the wiring is still not being held in a satisfactory manner in the lamp body, then this can be achieved retrospectively by optimum matching of the lateral elements or of the intermediate elements to the predetermined shape of the lamp body.

Preferably, as mentioned, the first line represents a mains and/or control line, or the first line harness comprises a mains and/or a control line. In particular, the second line represents a lamp line, or the second line harness comprises at least one lamp line.

The cross section of the lamp body can be round, polygonal, in particular quadrilateral or hexagonal, or else oval. It is particularly preferably manufactured from an extruded profile.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the various embodiments. In the following description, various embodiments are described with reference to the following drawings, in which:

FIG. 5 shows different cross sections for lateral and intermediate elements;

FIG. 6 shows one exemplary embodiment of a telescopic embodiment of a lateral or intermediate element, wherein FIGS. 6*b* and 6*c* show two different implementation options for locking of the two telescopic elements shown in FIG. 6*a;*

FIG. 7 shows a lateral element with a coupling apparatus for intermediate elements in the longitudinal direction, wherein FIGS. 7*b* to 7*e* show different cross sections for the intermediate elements;

DETAILED DESCRIPTION

The following detailed description refers to the accompanying drawings that show, by way of illustration, specific details and embodiments which may be practiced.

The same reference symbols are used for the same elements and elements having the same effect in the various drawings. These will therefore be described only once.

Figure 1:
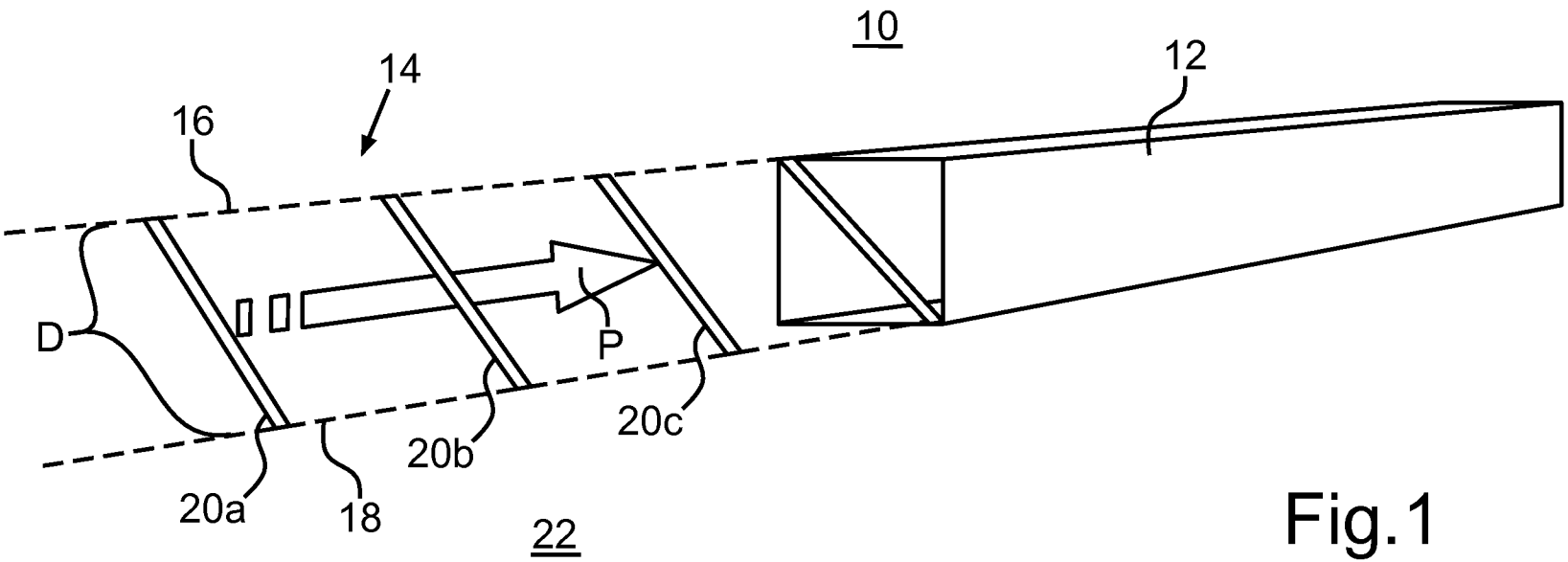
FIG. 1 shows a schematic illustration of an embodiment, in which wiring which has been prefabricated by means of a spacing apparatus is inserted in the form of a module into a lamp body.

FIG. 1 shows a schematic illustration of the principle for production of a lamp 10 according to an embodiment. This lamp 10 comprises a tubular lamp body 12 which, in the present case, has a square cross section and is manufactured from an extruded profile. Prefabricated wiring 14 comprises a first line harness 16 and a second line harness 18, which are fixed at a maximum distance D from one another, which corresponds to the internal diagonal of the lamp body 12, by spacing elements 20*a* to 20*c*. As indicated by the arrow P, this wiring is prefabricated outside the lamp body 12 in the form of a module, and is then pushed or pulled into the lamp body 12. The line harness 16 comprises lamp lines, while the line harness 18 comprises mains and control lines. The spacing elements 20*a* to 20*c* in this exemplary embodiment form a spacing apparatus 22.

Figure 2:
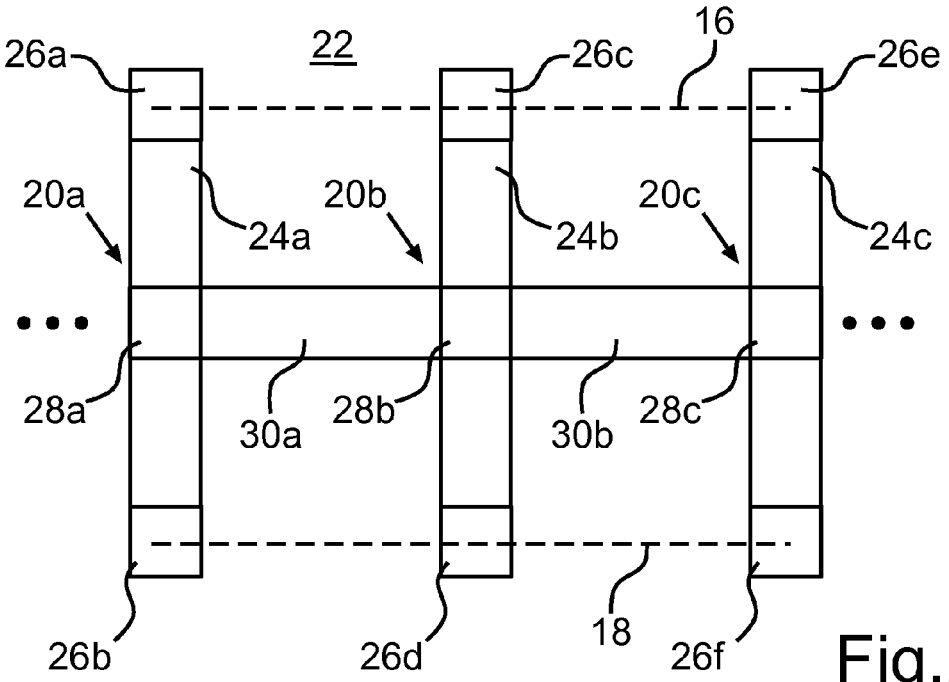
FIG. 2 shows a diagram relating to the design of different spacing apparatuses according to the various embodiments.

FIG. 2 shows a schematic illustration of the basic principle of the design of different spacing apparatuses 22 according to the various embodiments. By way of example once again, the illustration shows three spacing elements 20*a* to 20*c*. Each spacing element 20*a* to 20*c* has a respective lateral element 24*a* to 24*c*, at whose respective ends a holding apparatus 26*a* to 26*f* is provided for the respective line harnesses 16, 18.

Approximately in the center of each lateral element 24*a* to 24*c*, an optional coupling apparatus 28*a* to 28*c* is provided, which is designed to interact with a corresponding coupling apparatus of intermediate elements 30*a*, 30*b*, in order to fix the spacing elements 20*a* to 20*c* at a predeterminable distance from one another. While there is no need to use the coupling apparatuses 28*a* to 28*c* and the intermediate elements 30*a*, 30*b* for line harnesses 16, 18 composed of solid wire, their use is, however, advisable for line harnesses 16, 18 composed of braid, in order to prevent the lateral elements 24*a* to 24*c* being compressed when the prefabricated wiring is inserted into the lamp body 12.

Figure 3:
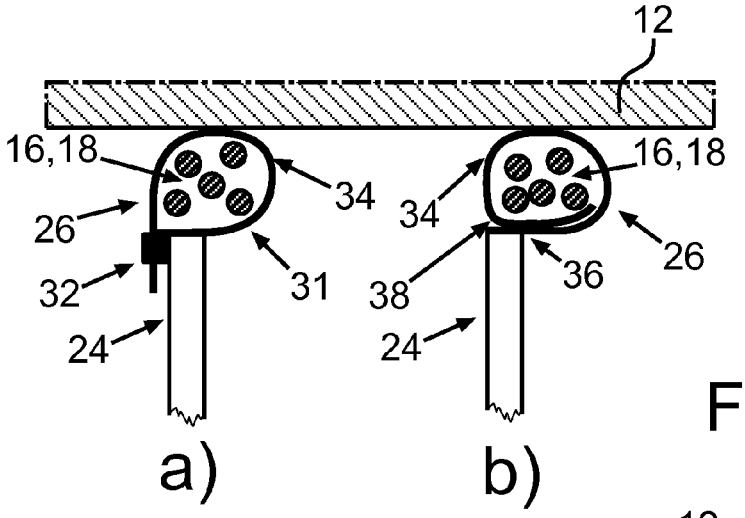
FIG. 3 shows two exemplary embodiments of a holding apparatus, wherein the holding apparatus is arranged between the inner face of the lamp body and a lateral element.

FIG. 3 shows a schematic illustration of two different exemplary embodiments of holding apparatuses 26, wherein the holding apparatuses 26 are coupled to a lateral element 24 such that the respective holding apparatus 26 is arranged between a lateral element 24 and the inner face of the lamp body 12. The pushing direction runs into the plane of the drawing. In the exemplary embodiment of a holding apparatus 26 illustrated in FIG. 3*a*, said holding apparatus 26 has a cable tie 31, whose closure 32 is fixed to the lateral element 24. This clearly shows the rounded area 34, which ensures that the prefabricated wiring can be inserted into the lamp body 12 without jamming. The exemplary embodiment of a holding apparatus 26 illustrated in FIG. 3*b* has a flexible spiral 36, into which the line harness 16 is inserted.

Figure 4:
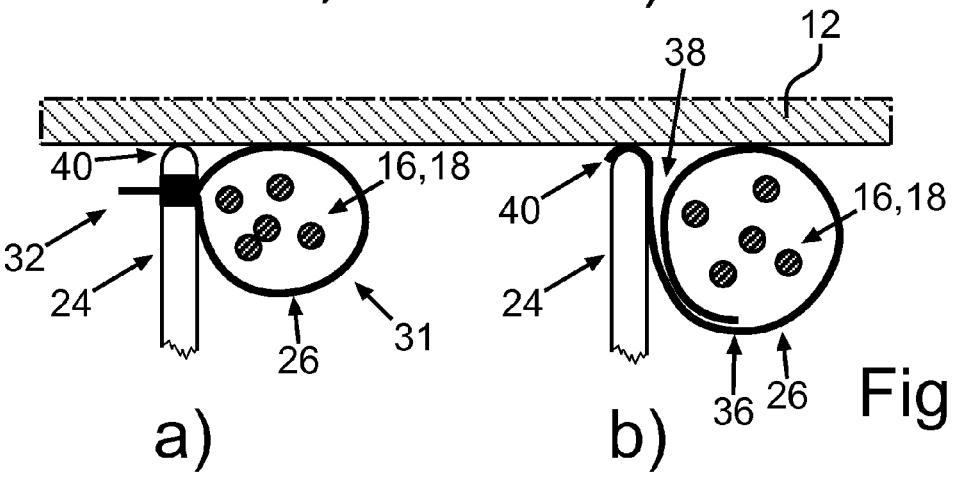
FIG. 4 shows two exemplary embodiments of a holding apparatus, wherein the holding apparatus is arranged at the side, alongside the lateral element.

FIG. 4 schematically illustrates two exemplary embodiments, in which the holding apparatus 26 is arranged at the side of a lateral element 24, such that the lateral element 24 makes contact with the inner face of the lamp body 12. In both exemplary embodiments, that end 40 of the lateral element 24 which makes contact with the inner face of the body 12 is rounded, in order to ensure that a prefabricated wiring is inserted into the lamp body 12 without jamming. The exemplary embodiment illustrated in FIG. 4*a* once again has a cable tie 31, while the exemplary embodiment illustrated in FIG. 4*b* has a flexible spiral 38.

By way of example, FIG. 5 shows five different cross sections a) to e) for the lateral elements 24 and the intermediate elements 30. The cross section may accordingly be, in particular, in the form of a plus sign (FIG. 5*a*), a rectangular shape (FIG. 5*b*), a Y-shape (FIG. 5*c*), an annular shape (FIG. 5*d*), and a circular shape (FIG. 5*e*).

FIG. 6*a* schematically illustrates one exemplary embodiment of a telescopic refinement of a lateral element 24 and of an intermediate element 30. In this case, a first telescopic element 42 can be pulled out of or pushed into a second telescopic element 44. The telescopic elements 42, 44 can be reversibly locked to one another by means of a locking apparatus 46. FIGS. 6*b* and 6*c* show embodiments of the locking apparatus 46. In the embodiment illustrated in FIG. 6*b*, studs are in each case fitted to the first telescopic element 42 and to the second telescopic element 44, allowing reversible movement with respect to one another. In the embodiment of a locking apparatus 46 illustrated in FIG. 6*c*, the telescopic elements 42, 44 each have triangular projections, which are designed such that they can engage in one another. Other embodiments are, of course, likewise feasible. The telescopic elements 42, 44 are preferably manufactured from plastic.

Figure 7:
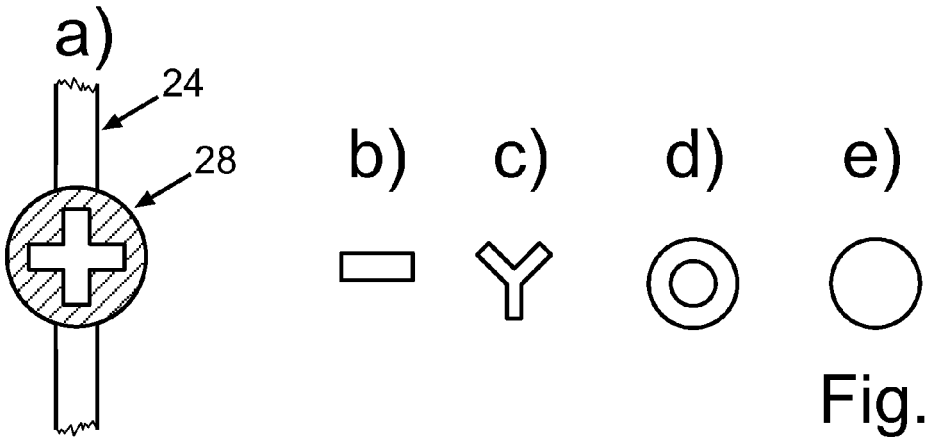

FIG. 7*a* shows an exemplary embodiment in which a coupling apparatus 28 for intermediate elements 30 is illustrated approximately centrally on a lateral element 24. The coupling apparatus 28 is matched to the cross section of the intermediate element 30, cf. FIG. 5. The coupling apparatus 28 in the exemplary embodiment illustrated in FIG. 7*a* thus has an opening in the form of a plus sign. The embodiments illustrated in FIGS. 7*b* to 7*e* correspond to the cross sections for intermediate elements 30 illustrated in FIGS. 5*b* to 5*e*.

Figure 8:
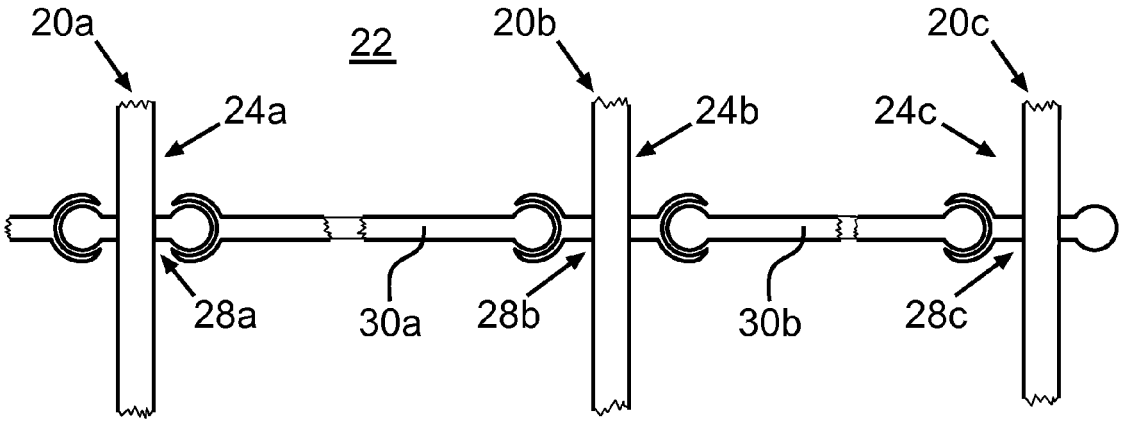
FIG. 8 shows a schematic illustration of a spacing apparatus with a plurality of spacing elements, which are coupled to one another by intermediate elements.

FIG. 8 shows an exemplary embodiment of a spacing apparatus 22, in which three lateral elements 24*a*, 24*b*, 24*c* are fixed with respect to one another by respective coupling apparatuses 28*a*, 28*b*, 28*c*, via intermediate elements 30*a*, 30*b*. This embodiment of a spacing apparatus 22 may be particularly suitable for fixing line harnesses, which contain lines composed of braid, at a predetermined distance from one another. In this case, the length of the intermediate elements 30*a*, 30*b* is chosen to be smaller the more flexible the line harnesses 16, 18 to be held are. The object of the intermediate elements 30*a*, 30*b* is, in particular, to make the prefabricated wiring sufficiently robust, in particular stiff, that it can be pushed into the lamp body 12 without changing the distances between the lateral elements 24*a*, 24*b*, 24*c*.

Figure 9:
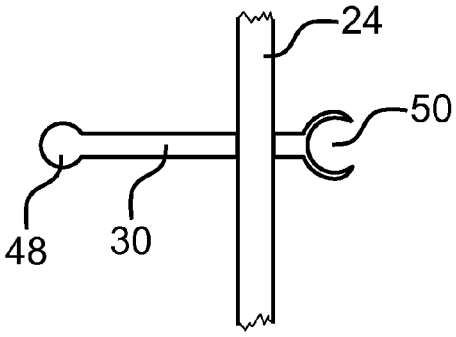
FIG. 9 shows a lateral element with an integrated longitudinal element.

FIG. 9 shows an exemplary embodiment of a lateral element 24 which already has an intermediate element 30. A male coupling apparatus 48 and a female coupling apparatus 50 are provided at the respective ends of the intermediate element 30. This allows a multiplicity of such lateral elements 24 to be coupled to one another, in order to form a spacing apparatus 22.

While there has been particularly shown and described specific embodiments, it should be understood by those skilled in the art that various changes in form and detail may be made therein without departing from the spirit and scope as defined by the appended claims.

The invention claimed is:

1. A lamp, comprising:

a tubular lamp body;

a prefabricated wiring and spacing apparatus configured to concurrently be introduced in the lamp body, the wiring including at least one first line harness and at least one second line harness, or at least one first line and at least one second line, are arranged in the tubular lamp body;

wherein the at least one first line harness and the at least one second line harness or the at least one first line and the at least one second line of the wiring are designed to be fixed by the spacing apparatus at a predeterminable distance from one another, at least in places, wherein the lamp body has a longitudinal axis and a lateral axis, wherein the spacing apparatus has a longitudinal axis and a lateral axis, wherein the longitudinal axis of the spacing apparatus runs parallel to the longitudinal axis of the lamp body when the spacing apparatus is arranged in the lamp body, and wherein the lateral axis of the spacing apparatus runs parallel to the lateral axis of the lamp body when the spacing apparatus is arranged in the lamp body, wherein the spacing apparatus has at least one spacing element, whose longitudinal axis and lateral axis run parallel to those of the spacing apparatus, wherein in the lateral direction, the at least one spacing element has a first holding apparatus which is arranged at its first end, for the first line harness or the first line, and has a second holding apparatus, which is arranged at its second end, for the second line harness or the second line, wherein the at least one spacing element comprises: at least one lateral element which extends in the lateral direction, wherein the at least one lateral element is designed to be stiff, and wherein the at least one lateral element is coupled between the first holding apparatus and the second holding apparatus;

wherein at least one of the first holding apparatus and the second holding apparatus is arranged between the at least one lateral element and the lamp body.

2. The lamp as claimed in claim 1, wherein the at least one lateral element is in contact with the lamp body, wherein at least one of the first holding apparatus and the second holding apparatus is arranged at the side on the at least one lateral element.

3. The lamp as claimed in claim 1, wherein at least one of the first holding apparatus and the second holding apparatus has a cable tie for holding the respective line or the respective line harness.

4. The lamp as claimed in claim 1, wherein at least one of the first holding apparatus and the second holding apparatus has a flexible spiral for holding the respective line or the respective line harness.

5. The lamp as claimed in claim 1, wherein the at least one lateral element has at least one first coupling apparatus in the longitudinal direction.

6. The lamp as claimed in claim 5, wherein the at least one spacing element comprises: at least one intermediate element which has at least one second coupling apparatus, wherein the second coupling apparatus is designed to interact with the first coupling apparatus, in order to couple two lateral elements to one another in the longitudinal direction.

7. The lamp as claimed in claim 1, wherein at least one of the at least one lateral element and at least one intermediate element has a telescopic apparatus for variation of a length of the at least one lateral element and at least one intermediate element.

8. The lamp as claimed in claim 7, wherein the telescopic apparatus has at least a first telescopic element, a second telescopic element and an unlocking apparatus, wherein the locking apparatus is designed to fix the first telescopic element at a predeterminable position with respect to the second telescopic element.

9. The lamp as claimed in claim 8, wherein the locking apparatus is designed to fix the first telescopic element reversibly with respect to the second telescopic element.

10. The lamp as claimed in claim 1, wherein the first line represents at least one of a mains and control line, or the first line harness comprises at least one of a mains and control line.

11. The lamp as claimed in claim 1, wherein the second line represents a lamp line, or the second line harness comprises a lamp line.

12. The lamp as claimed in claim 1, wherein the cross section of the lamp body is selected from a group consisting of round, polygonal, in particular quadrilateral or hexagonal, and oval.

13. The lamp as claimed in claim 1, wherein the at least one lateral element is designed to be torsionally stiff.

14. A spacing element for a spacing apparatus for a lamp comprising: a longitudinal axis and a lateral axis, wherein the longitudinal axis and the lateral axis run parallel to a longitudinal axis and a lateral axis of the spacing apparatus for the lamp, wherein the spacing apparatus has a longitudinal axis and a lateral axis, wherein the spacing apparatus has at least one spacing element, whose longitudinal axis and lateral axis run parallel to those of the spacing apparatus, wherein in the lateral direction, the at least one spacing element has a first holding apparatus which is arranged at its first end, for the first line harness or the first line, and has a second holding apparatus, which is arranged at its second end, for the second line harness or the second line, wherein the at least one spacing element comprises: at least one lateral element which extends in the lateral direction, wherein the at least one lateral element is designed to be stiff, and wherein the at least one lateral element is coupled between the first holding apparatus and the second holding apparatus;

wherein at least one of the first holding apparatus and the second holding apparatus is arranged between the at least one lateral element and the lamp body.

15. A method for production of a lamp, comprising the following steps:

providing a tubular lamp body; and providing prefabricated wiring having at least one first line harness and at least one second line harness or at least one first line and at least one second line;

comprising further steps:

providing a spacing apparatus, which is designed to fix at least the at least one first line harness and the at least one second line harness or the at least one first line and the at least one second line at a predeterminable distance from one another, at least in places;

coupling at least the prefabricated wiring having the at least one first line harness and the at least on second line harness or the at least one first line and the at least one second line to the spacing apparatus; and introducing the combination of at least the at least one first line harness and the at least one second line harness or the at least one first line and the at least one second line on the one hand and of the spacing apparatus on the other into the tubular lamp body, wherein the lamp body has a longitudinal axis and a lateral axis, wherein the spacing apparatus has a longitudinal axis and a lateral axis, wherein the longitudinal axis of the spacing apparatus runs parallel to the longitudinal axis of the lamp body when the spacing apparatus is arranged in the lamp body, and wherein the lateral axis of the spacing apparatus runs parallel to the lateral axis of the lamp body when the spacing apparatus is arranged in the lamp body, wherein the spacing apparatus has at least one spacing element, whose longitudinal axis and lateral axis run parallel to those of the spacing apparatus, wherein in the lateral direction, the at least one spacing element has a first holding apparatus which is arranged at its first end, for the first line harness or the first line, and has a second holding apparatus, which is arranged at its second end, for the second line harness or the second line, wherein the at least one spacing element comprises: at least one lateral element which extends in the lateral direction, wherein the at least one lateral element is designed to be stiff, and wherein the at least one lateral element is coupled between the first holding apparatus and the second holding apparatus;

wherein at least one of the first holding apparatus and the second holding apparatus is arranged between the at least one lateral element and the lamp body.

* * * * *